US011798768B2

(12) United States Patent
Xu et al.

(10) Patent No.: US 11,798,768 B2
(45) Date of Patent: Oct. 24, 2023

(54) FUSING DEVICE

(71) Applicant: BYD COMPANY LIMITED, Guangdong (CN)

(72) Inventors: Yunxiang Xu, Shenzhen (CN); Yafei Li, Shenzhen (CN); Lei Zheng, Shenzhen (CN); Yanhong Lin, Shenzhen (CN); Ting Zhang, Shenzhen (CN)

(73) Assignee: BYD COMPANY LIMITED, Guangdong (CN)

( * ) Notice: Subject to any disclaimer, the term of this patent is extended or adjusted under 35 U.S.C. 154(b) by 0 days.

(21) Appl. No.: 17/792,938

(22) PCT Filed: Dec. 29, 2020

(86) PCT No.: PCT/CN2020/140513
§ 371 (c)(1),
(2) Date: Jul. 14, 2022

(87) PCT Pub. No.: WO2021/143506
PCT Pub. Date: Jul. 22, 2021

(65) Prior Publication Data

US 2023/0170175 A1 Jun. 1, 2023

(30) Foreign Application Priority Data

Jan. 15, 2020 (CN) ..... 202010043544.1

(51) Int. Cl.
*H01H 85/048* (2006.01)
*H01H 85/02* (2006.01)
*H01H 85/165* (2006.01)

(52) U.S. Cl.
CPC ..... *H01H 85/048* (2013.01); *H01H 85/0241* (2013.01); *H01H 85/165* (2013.01)

(58) Field of Classification Search
CPC . H01H 85/048; H01H 85/0241; H01H 85/165
See application file for complete search history.

(56) References Cited

U.S. PATENT DOCUMENTS 1,818,822 A 8/1931 Stafford
5,892,427 A * 4/1999 Handcock ..... H01H 85/12 337/229

(Continued)

FOREIGN PATENT DOCUMENTS

CN 105539181 A 5/2016
CN 207433430 U 6/2018

(Continued)

OTHER PUBLICATIONS

Xu, Yousheng; Zhang, Hanping; Xie, Heshui, "Protector for Preventing Lithium Battery From Being Charged by Overvoltage", Jul. 4, 2013, Xiamen Set Electronics Co. Ltd., Entire Document (Translation of WO 2013097591). (Year: 2013).*

(Continued)

*Primary Examiner* — Stephen S Sul

(57) ABSTRACT

The present disclosure provides a multifunctional fuse. The multifunctional fuse includes a fuse element, a pre-charging resistor, and an inner housing. The inner housing is provided with a receiving cavity, the fuse element is received in the receiving cavity, and the pre-charging resistor is wound around an outer side of the inner housing and is in contact with the inner housing. The multifunctional fuse of the present disclosure resolves problems of large volumes and high costs of a pre-charging resistor and a fuse in a high voltage circuit in the related art.

7 Claims, 6 Drawing Sheets

(56) References Cited

U.S. PATENT DOCUMENTS

| | | | | |
|---|---|---|---|---|
| 10,347,402 | B1 * | 7/2019 | Du | H01H 85/048 |
| 2006/0284721 | A1 * | 12/2006 | Jakobsen | H01H 85/153 337/186 |
| 2012/0032774 | A1 * | 2/2012 | Jung | H01H 69/02 337/414 |
| 2014/0192457 | A1 | 7/2014 | Zhao | |
| 2015/0348731 | A1 * | 12/2015 | Douglass | H01H 85/175 337/198 |
| 2017/0150630 | A1 | 5/2017 | Lyon et al. | |
| 2018/0254163 | A1 * | 9/2018 | Lee | H01H 85/12 |
| 2019/0229377 | A1 * | 7/2019 | Kim | B60L 50/64 |

FOREIGN PATENT DOCUMENTS

| | | | | |
|---|---|---|---|---|
| CN | 109131164 | A | | 1/2019 |
| CN | 209328834 | U | * | 8/2019 |
| CN | 209374382 | U | | 9/2019 |
| CN | 217690680 | U | | 10/2022 |
| DE | 4116983 | A1 | | 11/1991 |
| EP | 0696123 | A1 | | 2/1996 |
| EP | 2660828 | A1 | | 11/2013 |
| EP | 3244436 | A1 | | 11/2017 |
| JP | 2006-310429 | A | | 11/2006 |
| TW | 282550 | B | | 8/1996 |
| WO | WO-2013097591 | A1 | * | 7/2013 ..... H01M 10/052 |

OTHER PUBLICATIONS

Chen, Xueming; Jiang, Qiu; Li, Daoyuan; Jiao Xuge, "S-shaped fuse link special for automobile", Aug. 30, 2019, Cfriend Electric Kunshan Co Ltd, Entire Document (Translation of CN 209328834). (Year: 2019).*

International Search Report and Written Opinion for Application No. PCT/CN2020/140513, dated Apr. 1, 2021, 8 pages.

* cited by examiner

FUSING DEVICE

CROSS-REFERENCE TO RELATED APPLICATIONS

This application is a national phase application of International Patent Application No. PCT/CN2020/140513, filed with the China National Intellectual Property Administration (CNIPA) on Dec. 29, 2020, which is based on and claims priority to and benefits of Chinese Patent Application No. 202010043544.1, filed on Jan. 15, 2020. The entire content of all of the above-identified applications is incorporated herein by reference.

FIELD

The present disclosure relates to the field of new energy vehicles, and more specifically, to a multifunctional fuse.

BACKGROUND

In the field of new energy vehicles, a pre-charging loop is pre-designed in a high voltage circuit for pre-charging before an electric vehicle is charged. In the pre-charging loop, a pre-charging resistor is a resistor that slowly charges high-voltage electrical components such as capacitors at the beginning of high-voltage power-on of the entire vehicle. Without the pre-charging resistor, high voltage electricity is directly loaded to the high-voltage electrical components and leads to an excessively large charging current, resulting in damage to the high-voltage electrical components. Therefore, the pre-charging resistor needs to be added during the design of the pre-charging loop, to ensure the safety of a high voltage circuit.

During actual operation of the electric vehicle, a unified power supply is used for a high voltage part, and a voltage, a current, and a power of each high voltage loop are affected each other. To reduce mutual implication when each high voltage loop has a high voltage fault, independent current fuses are arranged in each high voltage loop and a main loop, so that when each high voltage loop has short circuit and overcurrent faults, the current fuse is fused in time to cut off the loop, so as to avoid damage to other electrical components in the entire high voltage loop. In existing high voltage circuits, the pre-charging resistor and the fuse have large volumes, and the costs are high.

SUMMARY

In view of this, the present disclosure provides a multifunctional fuse, to resolve problems of large volumes and high costs of a pre-charging resistor and a fuse in a high voltage circuit in the related art.

The present disclosure provides a multifunctional fuse, including a fuse element, a pre-charging resistor, and an inner housing, where the inner housing is provided with a receiving cavity, the fuse element is received in the receiving cavity, and the pre-charging resistor is wound around an outer side of the inner housing and is in contact with the inner housing.

In an embodiment, the multifunctional fuse further includes an outer housing, where the outer housing is sleeved on the outer side of the inner housing, a gap is provided between the outer housing and the inner housing, and the pre-charging resistor is accommodated in the gap.

In an embodiment, the multifunctional fuse further includes a first conductive terminal and a second conductive terminal, where the first conductive terminal and the second conductive terminal are respectively connected to two ends of the inner housing to seal the receiving cavity.

In an embodiment, the multifunctional fuse further includes a crimp terminal, where the outer housing is provided with a crimp hole for the crimp terminal to pass through, the pre-charging resistor includes a first connection end and a second connection end, the first connection end is connected to the first conductive terminal, and the second connection end is connected to one end of the crimp terminal.

In an embodiment, the gap is filled with a first filler.

In an embodiment, the first conductive terminal includes a first connection portion and a second connection portion obliquely extending from the first connection portion, the first connection portion is configured to fix the first conductive terminal to a first end of the inner housing, so that the first conductive terminal covers an opening of the receiving cavity at the first end, and the second connection portion is configured to connect a first conductor; and the second conductive terminal includes a third connection portion and a fourth connection portion obliquely extending from the third connection portion, the third connection portion is configured to fix the second conductive terminal to a second end of the inner housing, so that the second conductive terminal covers an opening of the receiving cavity at the second end, and the fourth connection portion is configured to connect a second conductor.

In an embodiment, the second connection portion is provided with a first mounting groove, the first mounting groove is configured to fixedly connect the first conductor, the fourth connection portion is provided with a second mounting groove, the second mounting groove is configured to fixedly connect the second conductor, and an extending direction of the first mounting groove is perpendicular to an extending direction of the second mounting groove.

In an embodiment, the second connection portion is provided with a first through hole, the first through hole is configured for fixing the first conductor, the fourth connection portion is provided with a second through hole, and the second through hole is configured for fixing the second conductor.

In an embodiment, a second filler fills between the receiving cavity and the fuse element.

In an embodiment, the pre-charging resistor is a resistance wire, and the resistance wire is wound around the inner housing.

According to the multifunctional fuse of the present disclosure, the pre-charging resistor and the fuse element are integrated together. That is, when a pre-charging loop works, the pre-charging resistor can be first powered on to work to increase a resistance of the pre-charging loop, so as to reduce a pre-charging current of the pre-charging loop, thereby ensuring the safety of the pre-charging loop. Therefore, when it is ensured that a high voltage loop is connected, a current flowing through the high voltage loop falls within a threshold range of a safe current. In addition, when the pre-charging loop is disconnected and the high voltage loop is connected, the pre-charging resistor is disconnected, and the fuse element is powered on to work. Therefore, when an instantaneous large current occurs in the high voltage loop, the fuse element generates heat and is fused, to achieve the fuse protection performance of the fuse element, thereby achieving short circuit and overcurrent protection on the high voltage loop. Therefore, the multifunctional fuse effectively avoids a problem that a relatively large internal space of the entire vehicle is occupied by arranging the pre-charging resistor and a current fuse respectively, so that the pre-charging resistor and the current fuse can be integrated on one multifunctional fuse without changing the performance of the pre-charging resistor and the current fuse. On one hand, the multifunctional fuse has both a pre-charging protection function and an overcurrent and short circuit protection function, which is beneficial due to the multifunction of the multifunctional fuse. On the other hand, through integrated arrangement, the production costs are reduced, and the production efficiency is improved. In addition, because the volume is greatly reduced and the weight is reduced, it is more beneficial to adapt to a compact layout of the internal space of the entire vehicle, the flexibility is strong, and an application range is wide.

BRIEF DESCRIPTION OF THE DRAWINGS

To describe the technical solutions of the embodiments of the present disclosure or the related art more clearly, the accompanying drawings required for describing the embodiments or the related art are briefly introduced below. Apparently, the accompanying drawings in the following description show merely some embodiments of the present disclosure, and a person of ordinary skill in the art may still derive other drawings from these accompanying drawings without creative efforts.

DETAILED DESCRIPTION

The technical solutions in the embodiments of the present disclosure are clearly and completely described below with reference to the accompanying drawings in the embodiments of the present disclosure. Apparently, the described embodiments are merely some rather than all of the embodiments of the present disclosure. All other embodiments obtained by a person of ordinary skill in the art based on the embodiments of the present disclosure without making creative efforts shall fall within the protection scope of the present disclosure.

In the field of new energy vehicles, a high voltage electrical appliance of a high voltage system has a relatively large high voltage capacitor. If a high-voltage battery set directly supplies power to the high voltage electrical appliance, due to no charge or only a relatively small charge on the high voltage capacitor, a main relay is directly in communication with the high voltage capacitor, so that a high voltage of the high voltage battery set is directly loaded on the high voltage capacitor, which is equivalent to instantaneous short circuit, and an excessively large short circuit current causes damage to the high voltage electrical appliance. Therefore, during design of a high voltage circuit, a pre-charging loop needs to be designed, to pre-charge the high voltage capacitor of the high voltage electrical appliance, thereby ensuring the safety use of the high voltage circuit. In the pre-charging loop, a pre-charging resistor is a necessary electrical element for slowly charging the high voltage capacitor.

After the pre-charging loop is disconnected, the high voltage battery set supplies power to each high voltage loop in the high voltage circuit. Because a high voltage electrical appliance is arranged in each high voltage loop, a voltage, a current, and a power of each high voltage loop are affected each other. To reduce mutual implication when each high voltage loop has a high voltage fault, an independent current fuse is arranged in each high voltage loop, so that when each high voltage loop has short circuit and overcurrent faults, the current fuse is fused in time to cut off the loop, so as to avoid damage to other high voltage loops in the entire high voltage circuit. In the existing high voltage circuits, the pre-charging resistor and the fuse have large volumes, and the costs are high.

Figure 1:
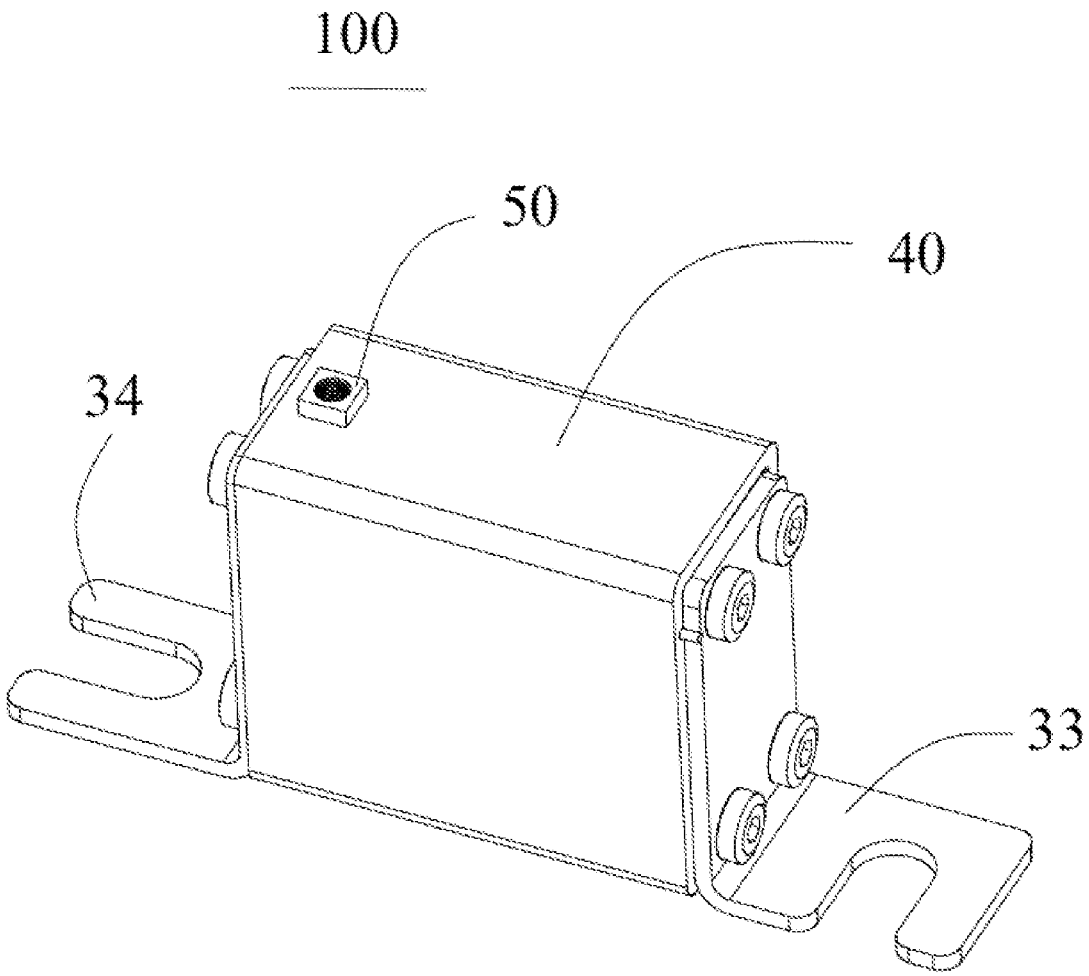
FIG. 1 is a schematic structural diagram of a multifunctional fuse according to an embodiment of the present disclosure.

In view of this, referring to FIG. 1, the present disclosure provides a multifunctional fuse 100. The multifunctional fuse 100 is connected to a high voltage circuit, to achieve both a pre-charging protection function and a short circuit and overcurrent protection function.

It should be noted that the high voltage circuit has a plurality of high voltage loops connected in parallel. Each high voltage loop is actually a power supply loop of a battery for a high voltage electrical appliance. The high voltage electrical appliance has a high voltage capacitor. When power is supplied to the high voltage electrical appliance, the high voltage capacitor needs to be charged first, to avoid damage to the high voltage electrical appliance caused by a direct impact of a large current on the high voltage capacitor. In other words, it is required to design a pre-charging loop to charge the high voltage capacitor. In addition, the principle in which the pre-charging loop charges the high voltage capacitor is that, a pre-charging resistor and a pre-charging relay are added to the pre-charging loop to control a charging current of the high voltage capacitor. A voltage U1 of the battery and a resistance value R of the pre-charging resistor may be learned in advance. When supplying powers, the pre-charging relay is first closed, and the pre-charging loop works. As a voltage U2 of the high voltage capacitor becomes larger, a pre-charging current $Ip=(U1-U2)/R$ becomes smaller. When the voltage is close to the voltage U1 of the battery, that is, when the voltage change amount $\Delta U=U1-U2$ is less than a preset threshold, the pre-charging relay is disconnected, and a main relay is connected to supply power to the high voltage loop, to effectively avoid damage to the high voltage electrical appliance caused by a large impulse current in the high voltage loop when the main relay is closed, thereby ensuring electrical safety of the high voltage electrical appliance.

In addition, after the pre-charging loop is disconnected, the battery supplies power to each high voltage loop in the high voltage circuit. A voltage, a current, and a power of each high voltage loop are affected each other. Therefore, to reduce mutual implication when each high voltage loop has a high voltage fault, an independent current fuse is arranged in each high voltage loop, so that when each high voltage loop has short circuit and overcurrent faults, the current fuse is fused in time to cut off the loop, so as to avoid damage to other high voltage loops in the entire high voltage circuit.

For example, the high voltage electrical appliance may be an electrical appliance such as a direct current-direct current (DC-DC) converter, an on-board charger (OBC), a positive temperature coefficient air-conditioner compressor, a motor controller unit (MCU), a high voltage power distribution unit (PDU), an oil pump, or a water pump. In addition, the high voltage electrical appliance is arranged in the high voltage loop and the pre-charging loop. In other words, when the pre-charging loop is connected, the battery charges the high voltage capacitor of the high voltage electrical appliance, so that a current flowing through the high voltage electrical appliance is adjusted by adjusting a voltage of the high voltage capacitor. Therefore, after pre-charging is completed, the pre-charging loop is disconnected, and the high voltage loop is connected. When the battery supplies power to the high voltage electrical appliance, the current flowing through the high voltage electrical appliance is a safe current, to effectively ensure that the high voltage electrical appliance is not damaged by a large impulse current.

Figure 2:
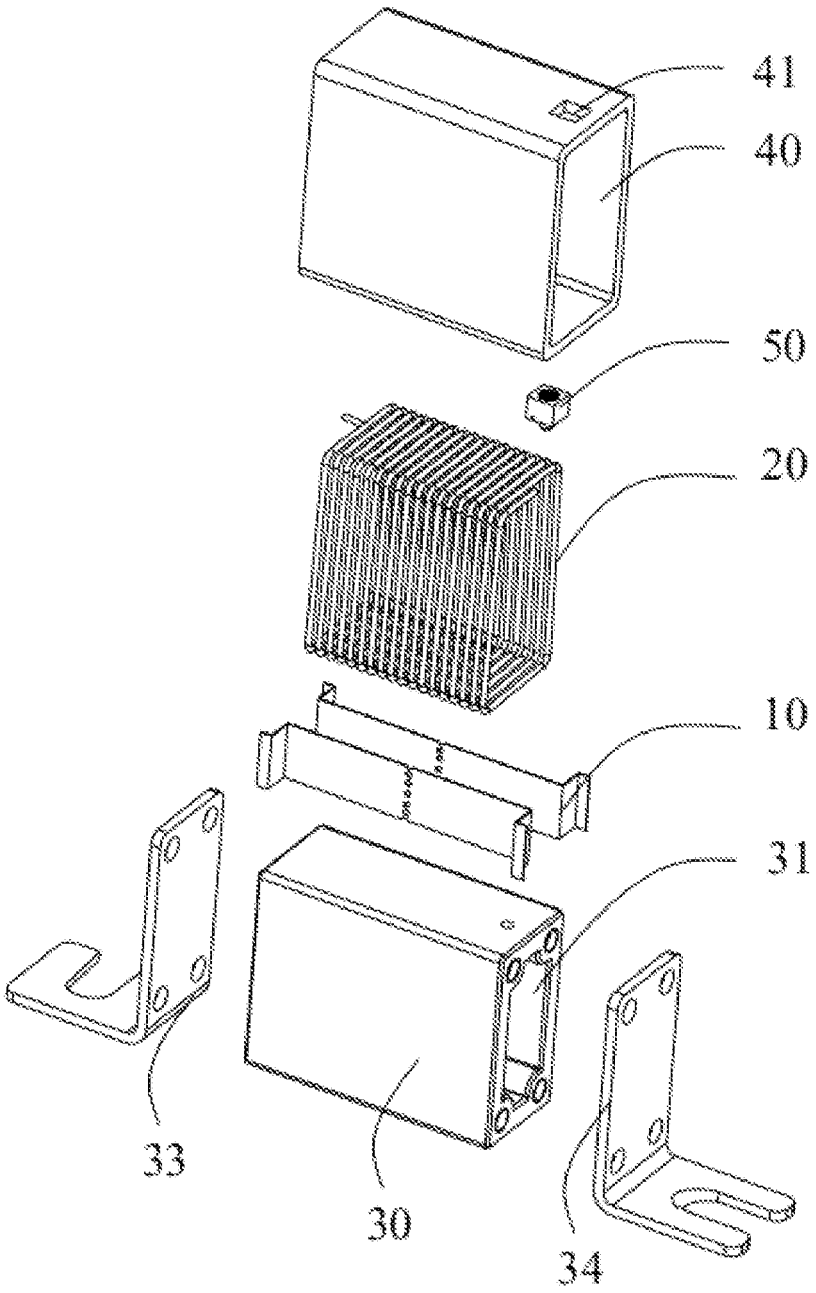
FIG. 2 is an exploded view of the multifunctional fuse shown in FIG. 1.

Referring to FIG. 1 and FIG. 2, in this embodiment of the present disclosure, the multifunctional fuse 100 includes a fuse element 10, a pre-charging resistor 20, and an inner housing 30. The inner housing is provided with a receiving cavity 31. The fuse element 10 is received in the receiving cavity 31, and the pre-charging resistor 20 is arranged on an outer side of the inner housing and is in contact with the inner housing 30.

It may be understood that the pre-charging resistor 20 is configured to connect in the pre-charging loop of the high voltage circuit in series and is powered on to work when the pre-charging loop is connected, to improve a resistance value of the pre-charging loop. The fuse element 10 is configured to connect in the high voltage loop of the high voltage circuit in series and is powered on to work after the pre-charging loop is disconnected, to perform short circuit and overcurrent protection on the high voltage loop. In addition, the pre-charging resistor 20 of the multifunctional fuse 100 is the pre-charging resistor of the pre-charging loop. That is, the pre-charging resistor 20 and the pre-charging relay are connected in the pre-charging loop of the high voltage circuit in series, to perform pre-charging protection on the high voltage electrical appliance. The fuse element 10 of the multifunctional fuse 100 can implement the fuse protection function of the current fuse of the high voltage loop. That is, the fuse element 10 is a core element of the current fuse of the high voltage loop, and the fuse element is connected in the high voltage loop in series, to perform overcurrent and short circuit protection on the high voltage electrical appliance.

The pre-charging resistor 20 and the fuse element 10 are integrated together. That is, when the pre-charging loop works, the pre-charging resistor 20 can be first powered on to work to increase a resistance of the pre-charging loop, so as to reduce a pre-charging current of the pre-charging loop, thereby ensuring the safety of the pre-charging loop. Therefore, when it is ensured that the high voltage loop is connected, a current flowing through the high voltage loop falls within a threshold range of a safe current. In addition, when the pre-charging loop is disconnected and the high voltage loop is connected, the pre-charging resistor 20 is disconnected, and the fuse element 10 is powered on to work. Therefore, when an instantaneous large current occurs in the high voltage loop, the fuse element 10 generates heat and is fused, to achieve the fuse protection performance of the fuse element, thereby achieving short circuit and overcurrent protection on the high voltage loop. Therefore, the multifunctional fuse 100 effectively avoids a problem that a relatively large internal space of the entire vehicle is occupied by arranging the pre-charging resistor and the current fuse respectively, so that the pre-charging resistor and the current fuse can be integrated on one multifunctional fuse 100 without changing the performance of the pre-charging resistor and the current fuse. On one hand, the multifunctional fuse 100 has both a pre-charging protection function and an overcurrent and short circuit protection function, which is beneficial due to the multifunction of the multifunctional fuse 100. On the other hand, through integrated arrangement, the production costs are reduced, and the production efficiency is improved. In addition, because the volume is greatly reduced and the weight is reduced, it is more beneficial to adapt to a compact layout of the internal space of the entire vehicle, the flexibility is strong, and an application range is wide.

It should be noted that a condition of determining whether the pre-charging loop complete pre-charged may be designed according to an actual situation. This is not specifically limited in the present disclosure. For example, the condition of determining whether pre-charging is completed may be whether 90% of a battery voltage is reached. When 90% of the battery voltage is reached, it is determined that pre-charging is completed. In this case, the pre-charging loop is disconnected, that is, a power-off operation is performed on the pre-charging resistor 20.

In an implementation, the multifunctional fuse 100 further includes an outer housing 40. The outer housing 40 is sleeved on the outer side of the inner housing 30 and a gap is provided between the outer housing and the inner housing 30. The pre-charging resistor 20 is accommodated in the gap. Certainly, in another implementation, the outer housing 40 may further be coated on the outer side of the inner housing 30 and cover the pre-charging resistor 20, that is, no gap exists between the outer housing and the inner housing.

Figure 3:
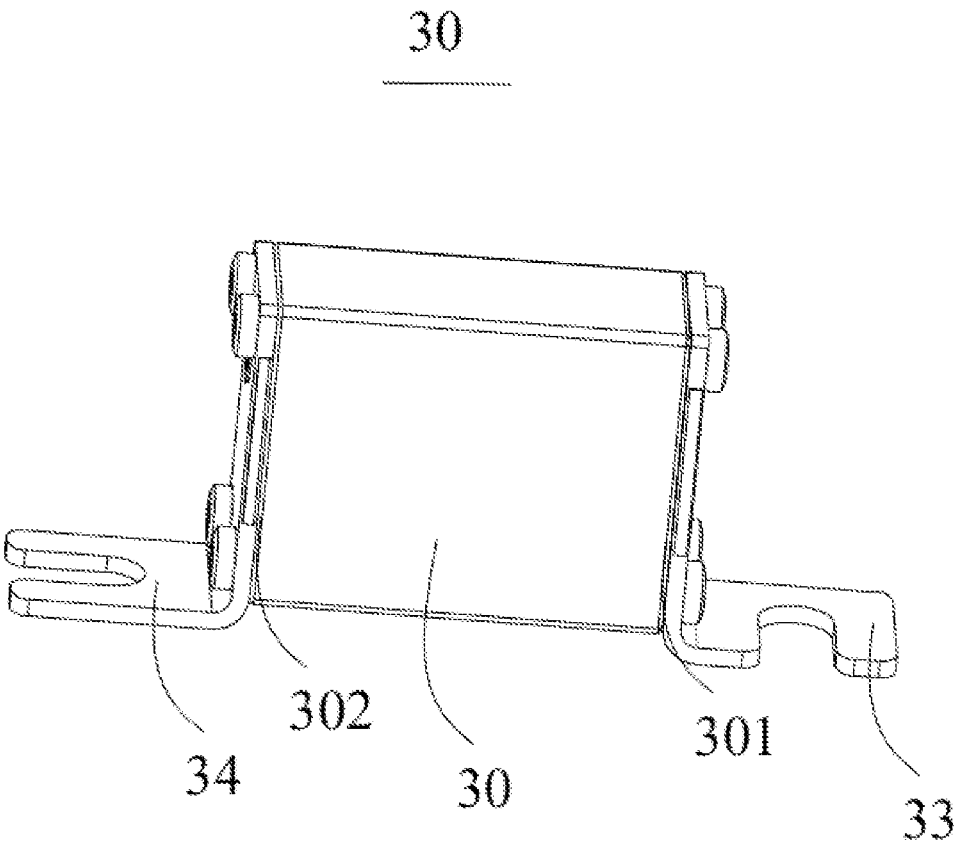
FIG. 3 is a schematic assembly diagram of an inner housing, a first conductive terminal, and a second conductive terminal of the multifunctional fuse shown in FIG. 1.

Referring to FIG. 2 and FIG. 3, in an implementation, the multifunctional fuse 100 further includes a first conductive terminal 33 and a second conductive terminal 34. The inner housing 30 includes a first end 301 and a first end 302 oppositely arranged. The first conductive terminal 33 and the second conductive terminal 34 are respectively connected to the first end 301 and the second end 302 of the inner housing 30, to match and seal the receiving cavity 31. Two opposing ends of the fuse element 10 are respectively connected to the first conductive terminal 33 and the second conductive terminal 34.

Figure 4:
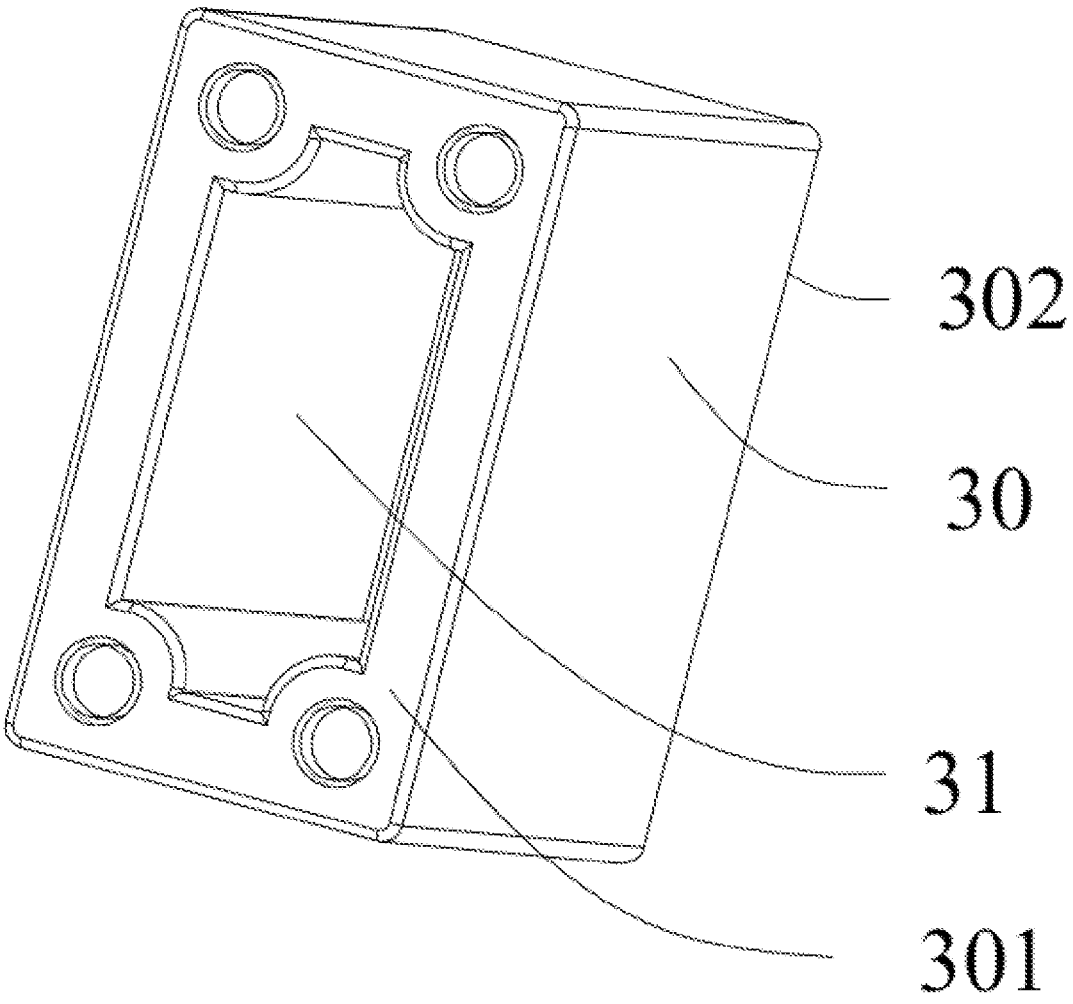
FIG. 4 is a schematic structural diagram of the inner housing shown in FIG. 3.

Referring to FIG. 4, in an implementation, the inner housing 30 is a cuboid, and each of the first end 301 and the second end 302 is provided with an opening. That is, the receiving cavity 31 formed by the inner housing 30 is a structure capable of being in communication with an external environment, so that the inner housing 30 is a cavity structure capable of being in communication with the external environment. The inner housing 30 is made of an insulating material with thermal conductivity. The inner housing 30 made of the insulating material has relatively good pressure bearing, thermal conductivity, and temperature resistance performance, and heat of the fuse element 10 received in the inner housing 30 can be quickly dissipated to the external environment, which is beneficial to improving the stability of the fuse element 10 during working. For example, the material of the inner housing 30 may be ceramic, plastic refractory, or the like. A person skilled in the art may select the material of the inner housing 30 according to an actual situation provided that the insulating material and the good pressure bearing and thermal conductivity are satisfied. This is not specifically limited in the present disclosure.

Figure 5:
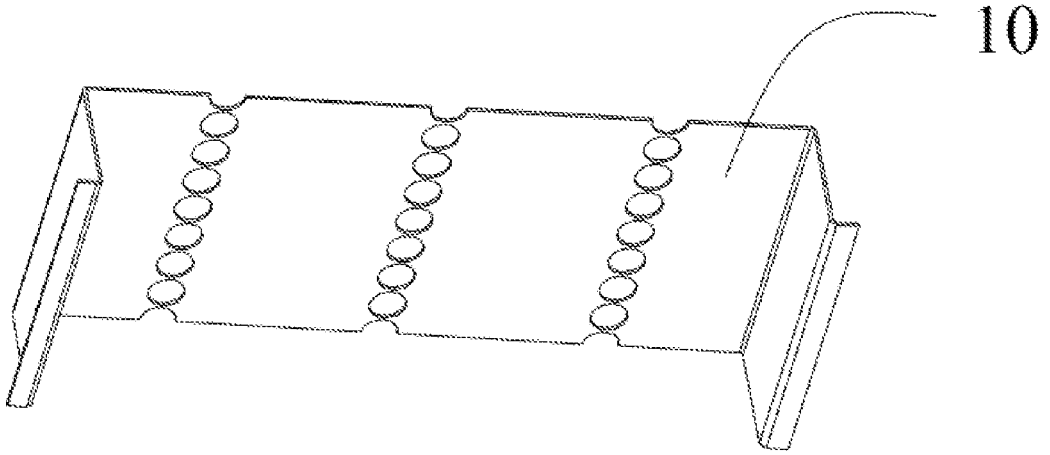
FIG. 5 is a schematic structural diagram of a fuse element of the multifunctional fuse shown in FIG. 1.

Referring to FIG. 5, the fuse element 10 received in the receiving cavity 31 of the inner housing 30 is a main working element for implementing a fuse function of the multifunctional fuse 100. The fuse element 10 has the characteristics of a relatively low melting point, a stable feature, and easy to fuse. The fuse element 10 is equivalent to a section of special wire connected in the high voltage loop in series. When a short circuit or an overcurrent occurs in the high voltage loop, a current flowing through the high voltage loop is excessively large, and the fuse element 10 is fused due to overheating, to cut off the high voltage loop. The fuse element 10 may be made of a metal material such as a lead-tin alloy, a silver-plated copper sheet, zinc, or silver, and may be in a shape of a wire, a grid, or a sheet. In this embodiment of the present disclosure, the fuse element 10 is in the shape of the sheet with a plurality of narrow necks. Certainly, in another embodiment, the fuse element 10 may be in another shape. This is not limited thereto.

The fuse protection function of the multifunctional fuse 100 is implemented by connecting the fuse element 10 to the high voltage loop in series. Therefore, in this embodiment of the present disclosure, the first conductive terminal 33 is arranged at the first end 301 of the inner housing 30, so that one end of the fuse element 10 received in the receiving cavity 31 can be connected to the first conductive terminal 33. The second conductive terminal 34 is arranged at the second end 302 of the inner housing 30, so that the other end of the fuse element 10 received in the receiving cavity 31 can be connected to the second conductive terminal 34. Further, the two ends of the fuse element 10 can be respectively connected to the first conductive terminal 33 and the second conductive terminal 34. Because the first conductive terminal 33 and the second conductive terminal 34 are made of conductive materials with low resistivity, good thermal conductivity, and a specific strength, the first conductive terminal 33 and the second conductive terminal 34 may be actually considered as metal conductors, so that the fuse element 10 can be connected to the high voltage loop in series by the metal conductors. When an overloaded or short circuit current flows through the fuse element 10, the fuse element generates heat and is fused, to cut off the high voltage loop, thereby achieving a simple structure, a convenient use, and a wide application range. It may be understood that both shapes and sizes of the first conductive terminal 33 and the second conductive terminal 34 may be adjusted according to an actual mounting requirement.

It should be noted that the connections between the fuse element 10 and the first conductive terminal 33 as well as the second conductive terminal 34 are electrical connections and physical connections, to implement both functions of conducting a current and improving a fastening force and to ensure that the fuse element 10 has good mounting stability and electrical conductivity without being disengaged, and it can be prepared for a smooth implementation of a fuse protection function when a large current passes through subsequently, which is beneficial to improving the safety and reliability of the high voltage loop.

Figure 6:
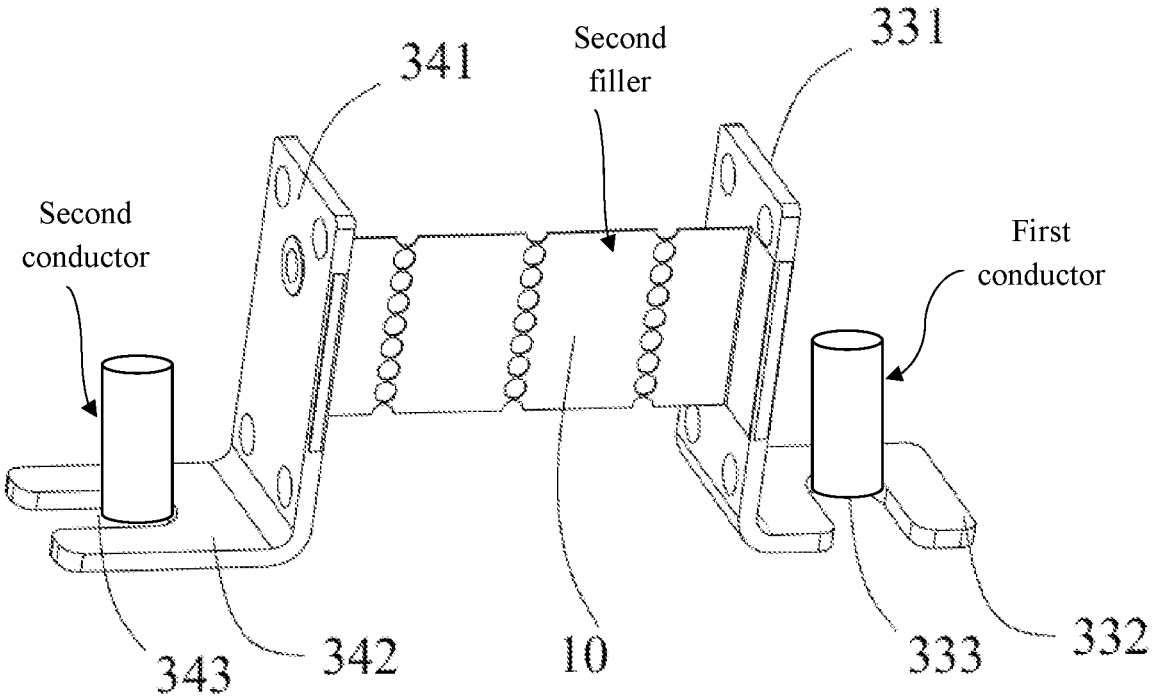
FIG. 6 is a partial schematic structural diagram of the multifunctional fuse shown in FIG. 1.

Referring to FIG. 3 and FIG. 6, the first conductive terminal 33 includes a first connection portion 331 and a second connection portion 332 obliquely extending from the first connection portion 331. The first connection portion 331 is configured to fix the first conductive terminal 33 to the first end 301 of the inner housing 30, so that the first conductive terminal 33 covers the opening of the receiving cavity 31 at the first end 301. The second connection portion 332 is configured to connect a first conductor (not shown in the figure).

Specifically, the first connection portion 331 is a structure matching a shape of the first end 301 of the inner housing 30, so that the first connection portion 331 can be aligned with the first end 301 of the inner housing 30 to cover the first end 301 of the inner housing 30. In addition, a size (a length*a width) of the opening provided at the first end 301 of the inner housing 30 is less than a size of the first connection portion 331, so that an end surface of the first end 301 of the inner housing 30 can provide a suitable mounting area for mounting the first connection portion 331, to ensure that the first connection portion 331 can have a sufficient contact area with the first end 301 of the inner housing 30 and can be quickly and stably fixed to the first end 301 of the inner housing 30. In this embodiment of the present disclosure, the first connection portion 331 is fixed to the first end 301 of the inner housing 30 through screws, and the first conductive terminal 33 is detachably connected to the first end 301 of the inner housing 30 by the screws, so that when the fuse element 10 in the receiving cavity 31 of the inner housing 30 is fused, the fuse element 10 can be changed by disassembling the first conductive terminal 33. In addition, the first conductive terminal 33 can be changed in time when it fails, to ensure the stability and reliability of the multifunctional fuse 100, thereby achieving strong flexibility and a wide application range. Certainly, in another embodiment, the first connection portion 331 may be fixed to the first end 301 of the inner housing 30 in another manner provided that the first end 301 of the inner housing 30 can be covered and a good fixing effect is achieved. This is not specifically limited in the present disclosure.

To facilitate connection between the first conductive terminal 33 and another electrical element in the high voltage loop, the second connection portion 332 is arranged for providing a mounting margin for the connection between the first conductive terminal 33 and the another electrical element. The second connection portion 332 obliquely extends from the first connection portion 331, to adapt to the compact layout of the internal space of the entire vehicle, thereby further improving the mounting stability and reliability of the first conductive terminal 33. In this embodiment of the present disclosure, the second connection portion 332 and the first connection portion 331 are in a right angle bending. Certainly, in another embodiment, the second connection portion 332 and the first connection portion 331 may be in an arc bending or in another geometric bending, or in a composite bending of a plurality of geometric shapes. This is not specifically limited in the present disclosure.

Further, the second connection portion 332 is provided with a first mounting groove 333. The first mounting groove 333 is configured to fixedly connect to the first conductor. In this embodiment of the present disclosure, the first mounting groove 333 is a U-shaped groove. An opening of the first mounting groove 333 runs through an edge of the second connection portion 332, so that the first mounting groove 333 can be conveniently fixedly connected to the first conductor. For example, the first conductor may be a conductive copper bar or another electrical element in the high voltage loop. The fixed connection may be engagement or a threaded connection, which may be designed by a person skilled in the art according to an actual requirement. This is not specifically limited in the present disclosure.

Continuing to refer to FIG. 3 and FIG. 6, the second conductive terminal 34 includes a third connection portion 341 and a fourth connection portion 342 obliquely extending from the third connection portion 341. The third connection portion 341 is configured to fix the second conductive terminal 34 to the second end 302 of the inner housing 30, so that the second conductive terminal 34 covers an opening of the receiving cavity 31 at the second end 302. The fourth connection portion 342 is configured to connect a second conductor.

The third connection portion 341 is a structure matching a shape of the second end 302 of the inner housing 30, so that the third connection portion 341 can be aligned with the second end 302 of the inner housing 30 to cover the second end 302 of the inner housing 30. In addition, a size (a length*a width) of the opening provided at the second end 302 of the inner housing 30 is less than a size of the third connection portion 341, so that an end surface of the second end 302 of the inner housing 30 can provide a suitable mounting area for mounting the third connection portion 341, to ensure that the third connection portion 341 can have a sufficient contact area with the second end 302 of the inner housing 30 and can be quickly and stably fixed to the second end 302 of the inner housing 30. In this embodiment of the present disclosure, the third connection portion 341 is fixed to the second end 302 of the inner housing 30 through screws, and the first conductive terminal 33 is detachably connected to the second end 302 of the inner housing 30 by the screws, so that when the fuse element 10 in the receiving cavity 31 of the inner housing 30 is fused, the fuse element 10 can be changed by disassembling the first conductive terminal 33. In addition, the first conductive terminal 33 can be changed in time when it fails, to ensure the stability and reliability of the multifunctional fuse 100, thereby achieving strong flexibility and a wide application range. Certainly, in another embodiment, the third connection portion 341 may be fixed to the second end 302 of the inner housing 30 in another manner provided that the second end 302 of the inner housing 30 can be covered and a good fixing effect is achieved. This is not specifically limited in the present disclosure.

To facilitate connection between the second conductive terminal 34 and another electrical element in the high voltage loop, the fourth connection portion 342 is arranged for providing a mounting margin for the connection between the second conductive terminal 34 and the another electrical element. The fourth connection portion 342 obliquely extends from the third connection portion 341, to adapt to the compact layout of the internal space of the entire vehicle, thereby further improving the mounting stability and reliability of the second conductive terminal 34. In this embodiment of the present disclosure, the fourth connection portion 342 and the third connection portion 341 are in a right angle bending. Certainly, in another embodiment, the fourth connection portion 342 and the third connection portion 341 may be in an arc bending or in another geometric bending, or in a composite bending of a plurality of geometric shapes. This is not specifically limited in the present disclosure.

In an implementation, the fourth connection portion 342 is provided with a second mounting groove 343. The second mounting groove 343 is configured to fixedly connect to the second conductor. In this embodiment of the present disclosure, the second mounting groove 343 is a U-shaped groove. An opening of the second mounting groove 343 runs through an edge of the fourth connection portion 342, so that the second mounting groove 343 can be conveniently fixedly connected to the second conductor. For example, the second conductor may be a conductive copper bar or another electrical element in the high voltage loop. The fixed connection may be engagement or a threaded connection, which may be designed by a person skilled in the art according to an actual requirement. This is not specifically limited in the present disclosure.

Further, a bending direction of the second connection portion 332 is opposite to a bending direction of the fourth connection portion 342. Specifically, the second connection portion 332 and the fourth connection portion 342 respectively extend oppositely along a positive direction and a negative direction in a same reference direction (an X direction or a Y direction), to greatly reduce the problems that are caused by margins reserved for the first connection portion 331 and the third connection portion 341 in a height direction (a Z direction) and to avoid mutual interference due to opposite extending, and an increase of the production costs, the occupied space, and the mounting difficulty.

Still further, an extending direction of the first mounting groove 333 is perpendicular to an extending direction of the second mounting groove 343. In other words, a direction of the opening of the first mounting groove 333 is different from a direction of the opening of the second mounting groove 343, so that the first conductive terminal 33 and the second conductive terminal 34 can be effectively prevented from moving back and forth due to an excessively large mounting tolerance of the left and right, thereby improve the mounting stability and reliability.

Certainly, in another embodiment, the second connection portion 332 may also be provided with a first through hole. The first through hole is configured for fixing the first conductor. The fourth connection portion 342 may also be provided with a second through hole. The second through hole is configured for fixing the second conductor. Both the first through hole and the second through hole are circular through holes. The circular through holes are provided for fixing the first conductor and the second conductor, to achieve good detachability and stability.

In this embodiment of the present disclosure, the first conductive terminal 33 and the second conductive terminal 34 are respectively fixed to the first end 301 and the second end 302 of the inner housing 30, and the first conductive terminal and the second conductive terminal can match and seal the receiving cavity 31 of the inner housing 30, to form an inner housing structure of the multifunctional fuse 100, so that the fuse element 10 of the receiving cavity 31 has good sealing performance and does not fail due to interference of the external environment. In addition, it may be understood that the inner housing 30, the first conductive terminal 33, the second conductive terminal 34, and the fuse element 10 inside the inner housing 30 jointly form a fuse of the multifunctional fuse 100, and the fuse is connected to the high voltage loop in series, to implement the fuse protection function of the multifunctional fuse 100. Specifically, when the high voltage loop is connected, under the action of a normal working current of the high voltage loop, the current flows through the multifunctional fuse 100 through a current path of "the first conductive terminal 33—the fuse element 10—the second conductive terminal 34", so that the fuse element 10 works normally without being fused. When the circuit has an instantaneous large current, the fuse element 10 generates heat and is fused in a short time, to quickly cut off the loop to protect the high voltage electrical appliance.

It should be noted that a specification of the fuse element 10 may be selected according to a rated voltage and a rated current of the loop. It is specified that a part of a rated voltage of the fuse of the multifunctional fuse 100 is greater than a maximum voltage that may occur in the high voltage loop, that is, a full charging voltage of the battery, to ensure that the fuse protection function can be smoothly and safely implemented.

Figure 7:
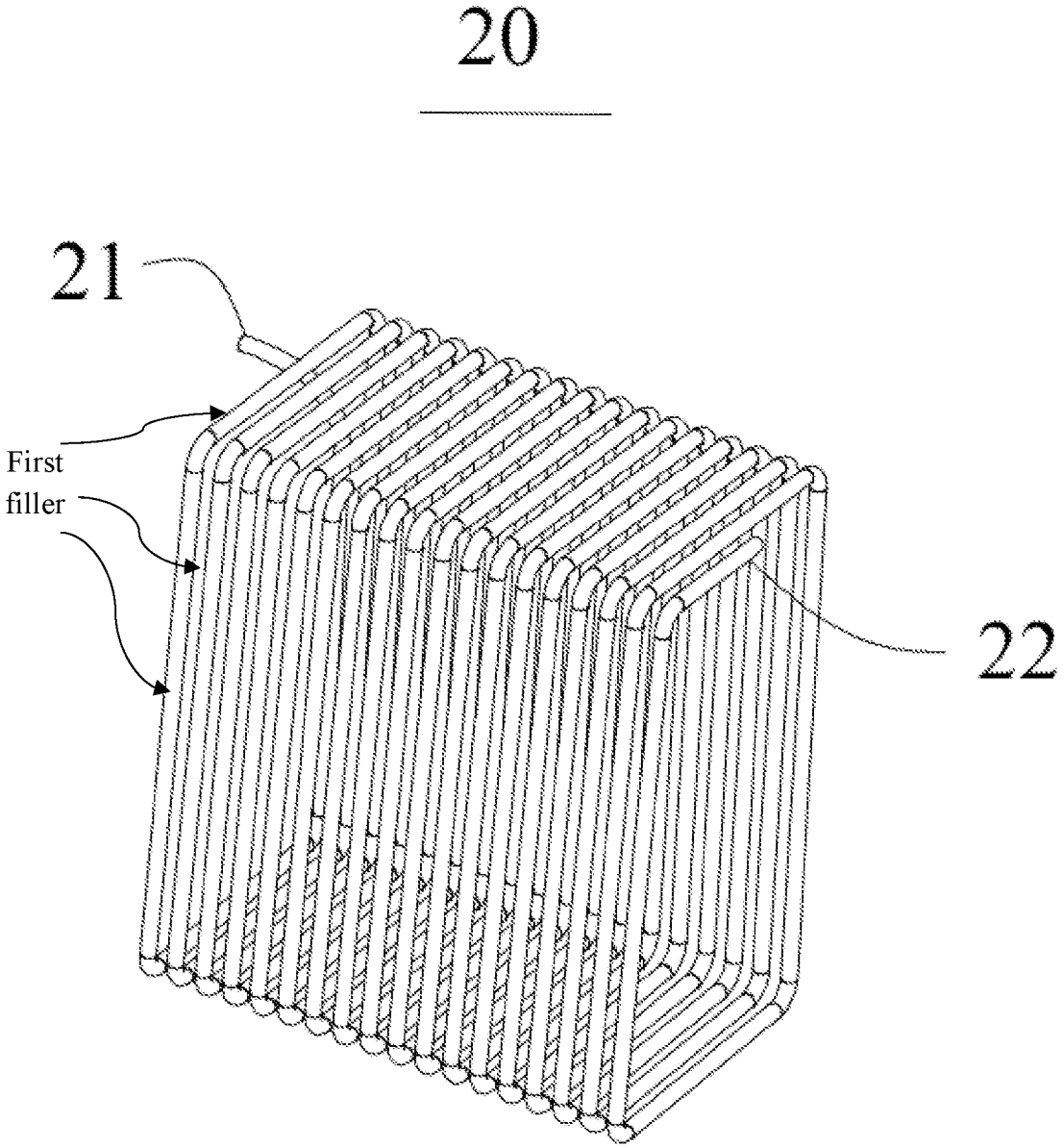
FIG. 7 is a schematic structural diagram of a pre-charging resistor of the multifunctional fuse shown in FIG. 1.

Referring to FIG. 2 and FIG. 7, the multifunctional fuse 100 further includes a crimp terminal 50. The outer housing 40 is provided with a crimp hole 41 for the crimp terminal 50 to pass through. The pre-charging resistor 20 includes a first connection end 21 and a second connection end 22. The first connection end 21 is connected to the first conductive terminal 33, the second connection end 22 is connected to one end of the crimp terminal 50, and the other end of the crimp terminal 50 passes through the crimp hole 41 to extend out of the outer housing 40, so that the other end is connected to the pre-charging relay of the pre-charging loop.

Specifically, the outer housing 40 is a hollow cuboid structure having openings at two ends and is made of an insulating material with thermal conductivity. The outer housing 40 made of the insulating material has relatively good pressure bearing, thermal conductivity, and temperature resistance performance, and heat of the pre-charging resistor 20 between the outer housing 40 and the inner housing 30 can be quickly dissipated to the external environment, which is beneficial to improving the stability of the pre-charging resistor 20 during working. For example, the material of the outer housing 40 may be ceramic, plastic refractory, or the like. A person skilled in the art may select the material of the outer housing 40 according to an actual situation provided that the insulating material and the good pressure bearing and thermal conductivity are satisfied. This is not specifically limited in the present disclosure.

Sizes and shapes of the openings at the two ends of the outer housing 40 are respectively adapt to the sizes and the shapes of the first connection portion 331 of the first conductive terminal 33 and the third connection portion 341 of the second conductive terminal 34, so that the first conductive terminal 33 and the second conductive terminal 34 are arranged at an outer side of the outer housing 40 to cover the outer housing 40, thereby improving the integrity of an appearance and the sealing performance on the outer housing 40. In other words, the first conductive terminal 33 and the second conductive terminal 34 not only have a function of sealing the receiving cavity 31 of the inner housing 30, but also have a function of covering the outer housing 40. Such a design diversifies the use performance of the first conductive terminal 33 and the second conductive terminal 34, and can ensure the flatness and beauty of the appearance of the multifunctional fuse 100, which is beneficial to improving a visual effect, thereby achieving a wide application range.

In addition, the size of the outer housing 40 is slightly greater than the size of the inner housing 30, so that the outer housing 40 can be smoothly sleeved on the outer side of the inner housing 30. In addition, a gap can be provided between the outer housing 40 and the inner housing 30, and the pre-charging resistor 20 can be accommodated in the gap. In an implementation, the pre-charging resistor 20 is a resistance wire, and the resistance wire is wound around the inner housing 30. That is, the pre-charging resistor 20 is a multi-ring structure and is arranged around an outer peripheral wall of the inner housing 30. An inner cavity wall of the outer housing 40 covers the pre-charging resistor 20. In this embodiment of the present disclosure, the entire resistance wire is wound around the outer peripheral wall ring by ring along the outer peripheral wall of the inner housing 30 and is tightly attached to the inner cavity wall of the outer housing 40. Further, a gap is provided between any two adjacent rings, to avoid interference because two rings are excessively close. In addition, a first filler (not shown in the figure) fills the gap, that is, among the inner housing 30, the outer housing 40, and the pre-charging resistor 20. The gap can provide a filling space for filling of the first filler.

Specifically, the pre-charging resistor 20 is surrounded by the first filler. On one hand, an air gap between the inner housing 30 and the outer housing 40 can be effectively reduced, on the other hand, the first filler can provide an effective heat transfer, so that the heat of the pre-charging resistor 20 is dissipated out, to improve the heat dissipation performance of the multifunctional fuse 100. For example, the first filler may be quartz sand.

In this embodiment of the present disclosure, one end of the pre-charging resistor 20 at the first conductive terminal 33 is a first connection end 21, and the first connection end 21 is connected to the first conductive terminal 33. It may be understood that the connection between the first connection end 21 and the first conductive terminal 33 is an electrical connection and a physical connection, to implement both functions of conducting a current and improving a fastening force and to ensure that the pre-charging resistor 20 has good mounting stability and electrical conductivity without being disengaged, so that the pre-charging resistor 20 can implement a pre-charging function through a conduction action of the first conductive terminal 33 when being subsequently connected to the pre-charging circuit, which is beneficial to improving the safety and reliability of the pre-charging loop.

One end of the pre-charging resistor 20 at the second conductive terminal 34 is a second connection end 22. The second connection end 22 is connected to one end of the crimp terminal 50, and the other end of the crimp terminal 50 passes through the crimp hole 41 to extend out of the outer housing 40, so that the other end is connected to the pre-charging relay of the pre-charging loop. In other words, the crimp terminal 50 needs to be exposed from the outer housing 40, so that the crimp terminal is connected to the pre-charging relay to connect the pre-charging resistor 20 to the pre-charging loop in series. The connection between the second connection end 22 and the crimp terminal 50 is an electrical connection and a physical connection, to implement both functions of conducting a current and improving a fastening force and to ensure that the pre-charging resistor 20 has good mounting stability and electrical conductivity without being disengaged, so that the pre-charging resistor 20 can implement a pre-charging function through a conduction action of the crimp terminal 50 when being subsequently connected to the pre-charging circuit, which is beneficial to improving the safety and reliability of the pre-charging loop.

It may be understood that the battery charges the high voltage capacitor at the beginning of power-on. Without being limited, a charging current is excessively large, which causes a large impact on the main relay, a rectifier device, the to-be-charged high voltage capacitor, and the like. Therefore, the pre-charging resistor 20 is used to limit the current. The pre-charging resistor 20 used herein is the pre-charging resistor. After the pre-charging resistor 20 is added, the high voltage capacitor is first pre-charged by using the pre-charging loop. In this way, when the high voltage loop is connected, the current may be controlled in a safety range, to ensure the normal operation of the high voltage electrical appliance.

When the pre-charging loop is connected, the inner housing 30 is configured to perform heat dissipation on the pre-charging resistor 20. Because a volume of the inner housing 30 is greater than a volume of a heat dissipating component when the pre-charging resistor is separately arranged, a heat dissipation area of the pre-charging resistor 20 is increased, to improve the heat dissipation performance of the pre-charging resistor 20, which is beneficial to dissipating the heat of the pre-charging resistor 20 better. In addition, because the volume of the inner housing 30 is increased, a length and a quantity of rings of the pre-charging resistor 20 wound around the inner housing are increased, to increase a power, so that a voltage that the pre-charging resistor 20 can withstand is further increased, thereby further improving the use effect of the pre-charging resistor 20.

Therefore, the inner housing 30 has a function of covering the fuse element 10 and also has a function of performing heat dissipation on the pre-charging resistor 20, so that both the fuse element 10 and the pre-charging resistor 20 can use the inner housing 30 during operations, that is, share the inner housing 30 that is used as a necessary component for implementing respective functions, which is beneficial due to the multifunction of the inner housing 30, improving the breadth of an application range, reducing the production costs, and improving the production efficiency.

It may be understood that the inner housing 30, the outer housing 40, the crimp terminal 50, the pre-charging resistor 20, and the first conductive terminal 33 jointly form a pre-charging resistor of the multifunctional fuse 100, and the pre-charging resistor is connected to the pre-charging loop in series, to implement the overcurrent and short circuit protection functions of the multifunctional fuse 100. Specifically, at the beginning of power-on, the pre-charging loop is connected, and under the action of a normal working current of the pre-charging loop, the current flows through the multifunctional fuse 100 through a current path of "the first conductive terminal 33—the pre-charging resistor 20—the crimp terminal 50", so that the pre-charging resistor 20 works normally to limit the current of the pre-charging loop. After pre-charging is completed, a power-off operation is performed on the pre-charging resistor 20, that is, the pre-charging loop is disconnected, and a normal power-on process is performed.

In this embodiment of the present disclosure, when the pre-charging loop is connected, the current flows through the multifunctional fuse 100 through the current path of "the first conductive terminal 33—the pre-charging resistor 20—the crimp terminal 50". When the pre-charging loop is disconnected and the high voltage loop is connected, the current flows through the multifunctional fuse 100 through the current path of "the first conductive terminal 33—the fuse element 10—the second conductive terminal 34". It may be understood that the first conductive terminal 33 is used when the pre-charging resistor 20 and the fuse element 10 are powered on to work, that is, the pre-charging resistor 20 and the fuse element 10 share the first conductive terminal 33 that is used as a necessary component for implementing respective functions, which is beneficial due to the multifunction of the first conductive terminal 33, improving the breadth of an application range, reducing the production costs, and improving the production efficiency.

Further, in this embodiment of the present disclosure, a second filler (not shown in the figure) fills between the receiving cavity 31 and the fuse element 10. In other words, the fuse element 10 is surrounded by the second filler. The second filler has good and stable physical and chemical characteristics. A heat transfer can be effectively provided by using the second filler, so that when the high voltage loop is cut off due to overcurrent, the second filler can absorb arc energy, to enhance an arc extinguishing capability of the multifunctional fuse 100.

It may be understood that two working states of the pre-charging resistor 20 and the fuse element 10 are not in parallel but in sequence. For example, when the entire vehicle meets a power-on condition, the pre-charging relay is first closed. In this case, the pre-charging resistor 20 is powered on to work, and the high voltage capacitor of the high voltage electrical appliance of the entire vehicle is pre-charged by using the pre-charging resistor 20. When a voltage value of the high voltage capacitor is greater than an expected voltage, for example, the expected voltage is 90% of a battery voltage, the pre-charging relay is disconnected, and the main relay is closed. In this case, the pre-charging resistor 20 is powered off, the fuse element 10 is powered on to work, and overcurrent and short circuit protection are performed on the high voltage loop by using the fuse element 10.

According to the multifunctional fuse 100 of the present disclosure, the pre-charging resistor 20 and the fuse element 10 are integrated together. That is, when a pre-charging loop works, the pre-charging resistor 20 can be first powered on to work to increase a resistance of the pre-charging loop, so as to reduce a pre-charging current of the pre-charging loop, thereby ensuring the safety of the pre-charging loop. Therefore, when it is ensured that a high voltage loop is connected, a current flowing through the high voltage loop falls within a threshold range of a safe current. In addition, when the pre-charging loop is disconnected and the high voltage loop is connected, the pre-charging resistor 20 is disconnected, and the fuse element 10 is powered on to work. Therefore, when an instantaneous large current occurs in the high voltage loop, the fuse element 10 generates heat and is fused, to achieve the fuse protection performance of the fuse element, thereby achieving short circuit and overcurrent protection on the high voltage loop. Therefore, the multifunctional fuse 100 effectively avoids a problem that a relatively large internal space of the entire vehicle is occupied by arranging the pre-charging resistor and the current fuse respectively, so that the pre-charging resistor and the current fuse can be integrated on one multifunctional fuse 100 without changing the performance of the pre-charging resistor and the current fuse. On one hand, the multifunctional fuse 100 has both a pre-charging protection function and an overcurrent and short circuit protection function, which is beneficial due to the multifunction of the multifunctional fuse 100. On the other hand, through integrated arrangement, the production costs are reduced, and the production efficiency is improved. In addition, because the volume is greatly reduced and the weight is reduced, it is more beneficial to adapt to a compact layout of the internal space of the entire vehicle, the flexibility is strong, and an application range is wide.

The embodiments of the present disclosure are described in detail above. The principles and implementations of the present disclosure are described through specific examples in this specification, and the descriptions of the embodiments are only intended to help understand the methods and core ideas of the present disclosure. Meanwhile, a person of ordinary skill in the art may make modifications to the specific implementations and application scopes according to the ideas of the present disclosure. In conclusion, the content of the specification should not be construed as a limitation to the present disclosure.

What is claimed is:

1. A fusing device, comprising: a fuse element, a pre-charging resistor, an inner housing, an outer housing, and crimp terminal, wherein the inner housing is provided with a receiving cavity, the fuse element is received in the receiving cavity, a first conductive terminal and a second conductive terminal are respectively connected to two ends of the inner housing to seal the receiving cavity, and the pre-charging resistor is arranged on an outer side of the inner housing and is in contact with the inner housing;

the outer housing is sleeved on the outer side of the inner housing, a gap is provided between the outer housing and the inner housing, and the pre-charging resistor is accommodated in the gap; and the outer housing is provided with a crimp hole for the crimp terminal to pass through, the pre-charging resistor comprises a first connection end and a second connection end, the first connection end is connected to the first conductive terminal, and the second connection end is connected to one end of the crimp terminal.

2. The fusing device according to claim 1, wherein the gap is filled with a first filler.

3. The fusing device according to claim 1, wherein the first conductive terminal comprises a first connection portion and a second connection portion extending from the first connection portion, the first connection portion is configured to fix the first conductive terminal to a first end of the two ends of the inner housing, so that the first conductive terminal covers an opening of the receiving cavity at the first end, and the second connection portion is configured to connect a first conductor; and the second conductive terminal comprises a third connection portion and a fourth connection portion extending from the third connection portion, the third connection portion is configured to fix the second conductive terminal to a second end of the two ends of the inner housing, so that the second conductive terminal covers an opening of the receiving cavity at the second end, and the fourth connection portion is configured to connect a second conductor.

4. The fusing device according to claim 3, wherein the second connection portion is provided with a first mounting groove, the first mounting groove is configured to fixedly connect the first conductor, the fourth connection portion is provided with a second mounting groove, the second mounting groove is configured to fixedly connect the second conductor, and a direction of the first mounting groove is perpendicular to an extending direction of the second mounting groove.

5. The fusing device according to claim 3, wherein the second connection portion is provided with a first through hole, the first through hole is configured for fixing the first conductor, the fourth connection portion is provided with a second through hole, and the second through hole is configured for fixing the second conductor.

6. The fusing device according to claim 1, wherein a second filler fills between the receiving cavity and the fuse element.

7. The fusing device according to claim 1, wherein the pre-charging resistor comprises a resistance wire, and the resistance wire is wound around the inner housing.

* * * * *